United States Patent [19]

Fischer

[11] 4,185,411

[45] Jan. 29, 1980

[54] STRUCTURAL ELEMENT AND A COVER MEMBER OF A TOY CONSTRUCTION KIT

[76] Inventor: Artur Fischer, Weinhalde 34, D-7244 Waldachtal 3, (Tumlingen), Fed. Rep. of Germany

[21] Appl. No.: 875,295

[22] Filed: Feb. 6, 1978

[30] Foreign Application Priority Data

Feb. 22, 1977 [DE] Fed. Rep. of Germany ... 7705362[U]
Aug. 23, 1977 [DE] Fed. Rep. of Germany ..... 2737844

[51] Int. Cl.[2] ..... A63H 33/08

[52] U.S. Cl. ..... 46/23; 46/19; 46/26

[58] Field of Search ..... 46/23, 16, 19, 20, 24–26, 46/27–29, 30, 31; 220/352, 353, 380; 35/19 A

[56] References Cited

U.S. PATENT DOCUMENTS

| | | | |
|---|---|---|---|
| 2,637,462 | 5/1953 | Becker | 220/352 |
| 2,780,028 | 2/1957 | McNeill | 46/19 |
| 3,381,844 | 5/1968 | Sieve | 46/24 X |
| 3,415,007 | 12/1968 | Howe | 46/25 X |
| 3,576,936 | 5/1971 | Fischer | 46/26 R |
| 3,852,909 | 12/1974 | Viebcke | 46/25 X |
| 4,106,657 | 8/1978 | Dogliotti | 46/25 X |

*Primary Examiner*—Pitrelli
*Attorney, Agent, or Firm*—Michael J. Striker

[57] ABSTRACT

A structural element of a toy construction kit comprises a hollow structural member having an inner passage, formations for connecting this structural member with another structural member, and a cover member detachably engageable in the inner passage of the structural member and provided with formations forming an aperture, such as a window or a door. The cover member has at least a pair of slots extending from one of its ends toward another end and forming therebetween a section which is separated by the slots from a remainder section of this portion. The thus-formed section has an outer surface provided with a projection. The slots may extend up to the other end of the portion of the cover member.

13 Claims, 3 Drawing Figures

FIG.1
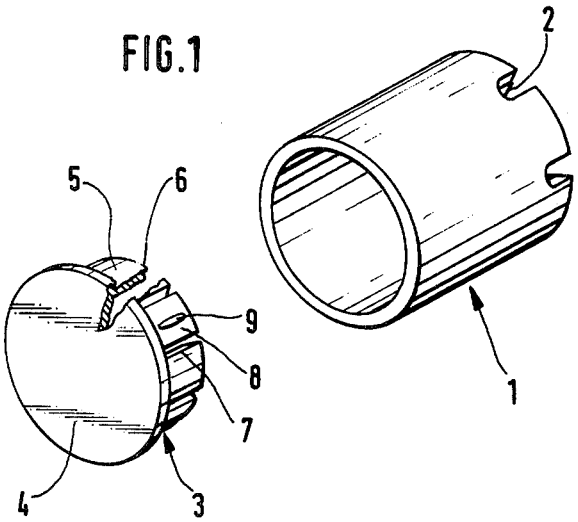
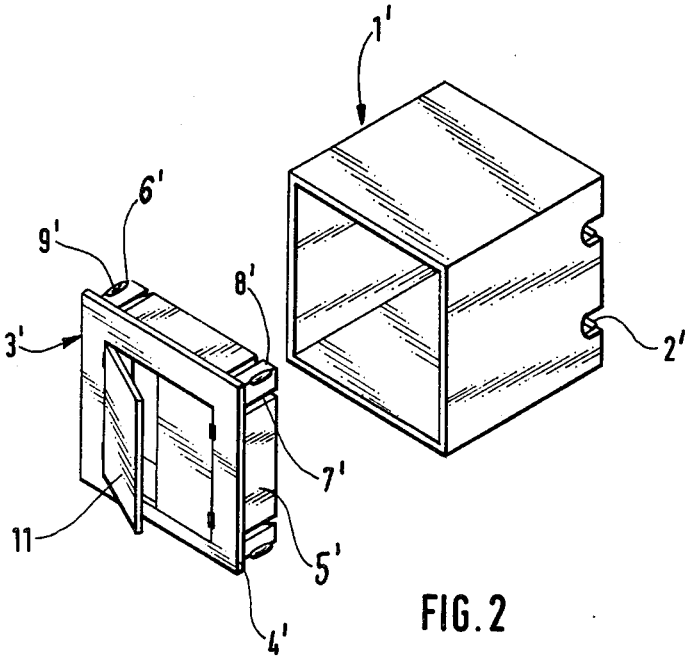
FIG.2

STRUCTURAL ELEMENT AND A COVER MEMBER OF A TOY CONSTRUCTION KIT

BACKGROUND OF THE INVENTION

The present invention relates to a structural element of a toy construction kit.

Small children have a very strong inclination for assembling of construction models from structural elements. The more appearance of the thus-assembled models corresponds to appearance of construction elements in an actual practice, the stronger is a desire of children to assemble such models from the structural elements. In order to provide for a possibility to assemble models which look very similar to the actual constructions, special structural elements have been proposed in the art which have means forming a window or a door and also have outer surfaces provided with connecting means for connecting these structural elements to other structural elements. These structural elements formed with the window or door can be assembled in a toy model instead of other structural elements. Such structural elements have some disadvantages. It is understood that they have a particular character or pattern and for this reason they cannot be used for other purposes except of for the purpose of forming a window or a door. Besides, they have different shapes and for this reason are very expensive.

SUMMARY OF THE INVENTION

Accordingly, it is an object of the present invention to provide a structural element of a toy construction kit which avoids the disadvantages of the prior art.

More particularly, it is an object of the present invention to provide a structural element of a toy construction kit which can be used for various purposes, and can form in a simple manner various parts which have functions and appearance corresponding to those of parts in an actual practice.

In keeping with these objects, and with others which will become apparent hereinafter, one feature of the present invention resides, briefly stated, in a structural element of a toy construction kit which has a hollow structural member having an inner passage, means for connecting this structural member with another structural member, and a cover member detachably engageable in the inner passage of the structural member and provided with means forming an aperture, such as a window or a door.

Since the structural member of the thus-formed structural element has means for connecting the same with another structural member, this hollow structural member can be used as a base structural element for assembling toy models. In order to form a toy construction model of an original appearance the cover member is inserted into the hollow structural member. Since the cover member is provided with means forming a window or a door, the thus-assembled model has an appearance of the construction unit fitting the window or the door, respectively. It is especially advantageous that not the entire structural element, but, instead, only the cover member is formed as special structural member applicable only for a particular purpose in assembling of the toy models. In addition to expenditures economy, also a greater possibility for assembling various constructions is provided for a child, since in order to assemble various toy models, it is not necessary to vary the entire structural elements, but, instead, it is sufficient to replace only the cover members.

Another feature of the present invention is that a portion of the cover member insertable in the inner passage of the hollow structural member has at least two slots extending from one of the ends of this portion toward another end thereof and forming therebetween a section which is separated by the slots from the remainder section of the portion. In order to close the hollow structural member by the cover member having means forming a window or a door, it is necessary to maintain very narrow tolerances which, on the one hand must guarantee an easy insertion of the cover member into the passage of the hollow structural member, and, on the other hand, must guarantee an easy removal of the cover member which tightly fits in the hollow structural member out of the latter. Even though such narrow tolerances are maintained the cover member can become inapplicable for assembling purposes since it is subjected to influence of surrounding atmosphere, wear and the like which affects its anti-friction properties and adhesive properties.

When the section of the portion of the cover member which is insertable into the passage of the hollow structural member is formed separate from the remainder section of this portion by the two slots, this section becomes elastically yieldable. When the portion of the cover member is inserted into the passage of the hollow structural member, the thus-formed section of this portion is forced inwardly under the action of the projection provided on the outer surface of the section. Independently of a wear and increased tolerances the elastically yieldable section of the cover member provides for reliable clamping engagement between the cover member and the hollow structural member with constant adhesive characteristics and friction characteristics.

When the portion of the cover member insertable into the passage of the hollow structural member is annular, it is advantageous when three such sections are formed in this portion so as to provide an additional centering effect. Preferably, the slots forming the separate section of the portion of the cover member extend from one end of the portion up to the other end thereof. The projection formed on the outer surface of these sections may be formed as a cam-like projection.

Still another feature of the present invention is that, when the inner passage of the hollow structural member has a cornered cross-section, the portion of the cover member insertable into the hollow structural member has also a cornered cross section, and the abovementioned separate section is formed as a corner section of this portion. It is advantageous when the projection is formed on an edge of these corner sections of the portion of the cover member. Preferably several such projections are provided on the edges of all the corner sections of the cover member.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a perspective view showing a structural element of the construction kit, including a hollow annular structural member and a cover member insertable in the latter;

FIG. 2 is a perspective view showing a structural element of a construction kit, including a hollow quadrangular structural member and a cover member insertable in the latter.

DESCRIPTION OF THE PREFERRED EMBODIMENTS

Figure 3:
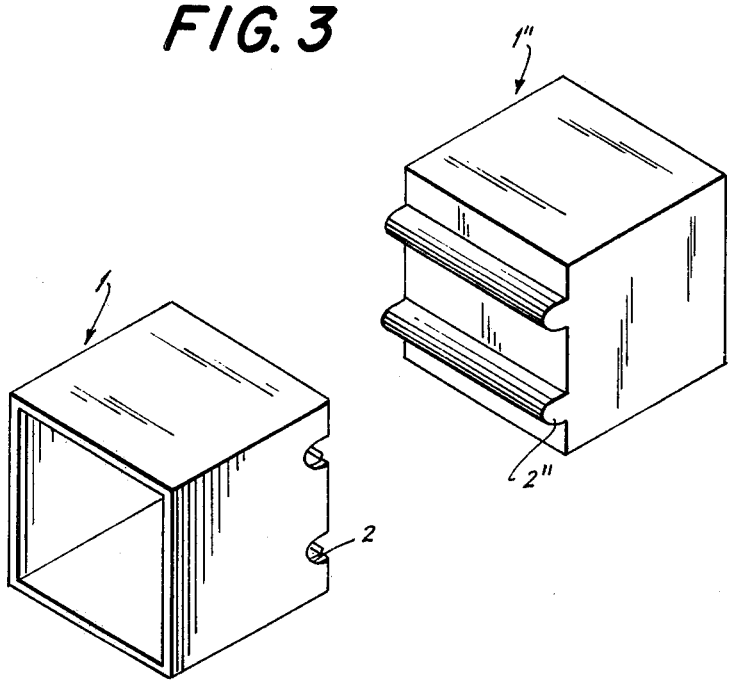
FIG. 3 is a view showing a hollow structural element connectable with another structural element of a construction kit.

A structural element of a construction kit in accordance with the present invention is shown in the drawing. The structural element shown in FIG. 1 includes a hollow structural member having a cylindrical cross-section and identified in toto by reference numeral 1. The structural member has an inner passage and means for connecting this member with another structural member. This connection is particularly shown in FIG. 3 of the drawing. In this FIG. the structural member 1 is connected with the other structural element 1" by interengaging connecting means 2 and 2". The structural member 1 has an undercut groove 2, whereas the structural member 1" has elongated undercut projections 2" engageable in the undercut grooves 2 of the structural member 1.

In order to close the hollow structural member 1, a cup-shaped cover member 3 is provided. The cover member 3 has a portion 5 having a contour corresponding to a contour of the inner passage of the hollow member 1 and insertable into this passage. In order to limit the insertion of the cover member 3 into the inner passage of the hollow structural member 1, an additional portion 4 is provided. The portion 4 extends outwardly beyond an outer surface of the portion 5 of the cover member 3.

The portion 5 has at least two slots 7 extending from a marginal edge 6 of the cover member towards the additional portion 4 thereof. It is understood that the slots 7 may extend up to the additional portion 4. The two slots 7 form therebetween a section 8 which is separated by these slots from a remainder section of the portion 5 of the cover member 3. The thus-formed section 5 is elastically yieldable. Several pairs of the slots 7 may be formed in the portion 5 so as to form in the latter several such elastically yieldable sections 8. A cam-shaped projection 9 is arranged on an outer surface of the section 8. When the portion 5 of the cover member 3 is inserted into the inner passage of the hollow structural member 1, the sections 8 thereof are forced inwardly by cooperation of the projections 9 with an inner surface of the hollow structural member 1. Since the sections 8 are elastically yieldable the cover member is maintained in a clamping engagement with the hollow structural member 1. The cover member 3 may be provided with means forming an aperture, such as a window or a door.

A cover member provided with means forming an aperture, such as a window or a door, is particularly shown in FIG. 2. The hollow structural element 1' has an inner passage having a cornered cross section. The portion 5' of the cover member 3' has also cornered cross-section corresponding to the cross-section of the inner passage of the hollow structural member 1'. The slots 7' are so formed in the portion 5' of the cover member 3' that the elastically yieldable section of this portion is formed as a corner section 8'. It is understood that several such corner sections 8' may be formed in the portion 5' in a number corresponding to a number of the corners of the cross section of the portion 5'. The section 8' of the portion 5' is provided with a cam-shaped projection 9' which preferably is formed in an edge of the corner section 8'. The projections 9' guarantee centering of the cover member 3' relative to the hollow structural member 1'. The cover member 3' is provided with means forming an aperture, such as a window or a door, and identified with the reference numeral 11. The cover member 3 is detachably insertable into the inner passage of the hollow structural member 1'. The structural members 1 and 1', taken without the cover members 3 and 3' can be used for forming various structural elememts. On the other hand, when the cover members 3 and 3' are inserted into the hollow structural members 1 and 1', respectively, they together form structural elements of a construction provided with an aperture such as a window or a door.

It will be understood that each of the elements described above, or two or more together, may also find a useful application in other types of constructions differing from the types described above.

While the invention has been illustrated and described as embodied in a structural element and a cover member of a toy construction kit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A structural element of a toy construction kit, comprising a hollow structural member having an inner passage; means for connecting said structural member with another structural member; and a cover member detachably engageable in said inner passage of said structural member and provided with means forming an aperture, such as a window or a door, said cover member having a portion insertable in and engageable with said inner passage of said hollow structural member and having two ends spaced from one another, said portion of said cover member having at least two slots extending from one of said ends toward the other end and forming therebetween a section which is separated by said slots from a remainder section of said portion, said section having an outer surface provided with a projection.

2. The structural element as defined in claim 1, wherein said connecting means is formed in said hollow structural member and includes an undercut formation.

3. The structural element as defined in claim 1, wherein one of said ends is a leading end and the other end is a trailing end, as considered in the direction of insertion of said portion of said cover member into said structural member, said slots extending from and being open at said leading end of said portion of said cover member.

4. The structural element as defined in claim 1, wherein said slots extend up to said other end of said portion of said cover member.

5. The structural element as defined in claim 1, wherein said cover member has a further section provided at said other end of said first-mentioned section, said slots extending up to said further section of said portion of said cover member.

6. The structural element as defined in claim 1, wherein said projection is cam-like.

7. The structural element as defined in claim 1, wherein said portion of said cover member is annular and has an axis, said slots extending in an axial direction.

8. The structural element as defined in claim 1, wherein said inner passage of said hollow structural member and said portion of said cover member have a cornered cross section, said slots being located so that said separate section is formed as a corner section of said portion of said cover member.

9. The structural element as defined in claim 8, wherein said corner section has an edge, said projection being formed on said edge of said corner section.

10. The structural element as defined in claim 9, wherein said corner section has an edge, said slots being located at opposite sides of said edge of said corner section.

11. The structural element as defined in claim 1, wherein said two slots form a first pair of slots, said portion of said cover member having at least one further pair of slots forming therebetween one further such section separated by the slots of said further pair from a remainder section of said portion.

12. The structural element as defined in claim 1, wherein said cover member is cup-shaped.

13. A cup-shaped cover member for insertion into a hollow structural member of a construction kit, comprising a body portion engageable in the hollow structural member and having two spaced ends, said body portion having at least one pair of slots extending from one of said ends toward the other end and forming therebetween a section of said body portion which is separated by said slots from a remainder section of said portion, said section having an outer surface provided with a projection; a further portion at said other end of said body portion; and means in said further portion, forming a window or a door.

* * * * *